US009429045B2

(12) United States Patent
Brückner et al.

(10) Patent No.: US 9,429,045 B2
(45) Date of Patent: Aug. 30, 2016

(54) METHOD FOR OPERATING A GAS AND STEAM TURBINE PLANT AND MONITORING A LIQUID LEVEL IN A PLURALITY OF DOWNPIPES

(75) Inventors: Jan Brückner, Uttenreuth (DE); Rudolf Hess, Erlangen (DE); Erich Schmid, Marloffstein (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 2161 days.

(21) Appl. No.: 12/524,872

(22) PCT Filed: Jan. 28, 2008

(86) PCT No.: PCT/EP2008/050954

§ 371 (c)(1),
(2), (4) Date: Dec. 2, 2009

(87) PCT Pub. No.: WO2009/024358

PCT Pub. Date: Feb. 26, 2009

(65) Prior Publication Data

US 2010/0089024 A1 Apr. 15, 2010

(30) Foreign Application Priority Data

Jan. 30, 2007 (EP) ..... 07002014

(51) Int. Cl.
*F01K 23/10* (2006.01)

(52) U.S. Cl.
CPC ..... *F01K 23/108* (2013.01)

(58) Field of Classification Search
CPC ..... F01K 23/108; F01D 25/30; F02C 3/34; F02C 1/08
USPC ..... 60/39.182, 39.5, 39.52, 779, 670, 675, 60/676, 693; 122/1 R, 7 R, 7 B
See application file for complete search history.

(56) References Cited

U.S. PATENT DOCUMENTS

| | | | | |
|---|---|---|---|---|
| 3,751,886 | A * | 8/1973 | Sokolowski | 55/318 |
| 3,953,966 | A * | 5/1976 | Martz et al. | 60/783 |
| 3,965,675 | A * | 6/1976 | Martz et al. | 60/39.182 |
| 4,395,885 | A * | 8/1983 | Cozby | 60/669 |
| 4,501,233 | A * | 2/1985 | Kusaka | 122/406.4 |

(Continued)

FOREIGN PATENT DOCUMENTS

| | | | |
|---|---|---|---|
| CA | 1273856 | A1 | 9/1990 |
| DE | 19510619 | A1 | 9/1996 |

(Continued)

*Primary Examiner* — Craig Kim

(57) ABSTRACT

A method for operating a gas and steam turbine plant is provided. In the plant, the flue gas that escapes from a gas turbine is routed through a waste gas steam generator and where a flow medium that is used to drive a steam turbine is conducted in a flow medium circuit that includes several pressure stages. At least one of the pressure stages has an evaporator circuit with a steam collection drum that has a plurality of downpipes connected to the steam collection drum and a plurality of rising pipes downstream of the downpipes that are likewise connected to the steam collection drum and are heated by the flue gas in the waste heat steam generator. The height of the fluid column formed by the flow medium in the downpipes is monitored and a transient dry operation of the evaporator circuit can thus be detected and safeguarded against.

14 Claims, 2 Drawing Sheets

(56) References Cited

U.S. PATENT DOCUMENTS

| | | | | |
|---|---|---|---|---|
| 4,573,323 | A * | 3/1986 | Mock | 60/665 |
| 4,854,121 | A * | 8/1989 | Arii et al. | 60/39.182 |
| 4,926,931 | A * | 5/1990 | Larinoff | 165/111 |
| 5,771,846 | A | 6/1998 | Ruchti | |
| 6,237,321 | B1 * | 5/2001 | Schmid et al. | 60/783 |
| 6,412,285 | B1 * | 7/2002 | Ranasinghe et al. | 60/782 |
| 6,694,744 | B1 * | 2/2004 | Smith | 60/775 |
| 7,074,259 | B2 * | 7/2006 | Liebig | 95/264 |
| 2007/0204623 | A1 * | 9/2007 | Rollins, III | 60/772 |

FOREIGN PATENT DOCUMENTS

| | | | |
|---|---|---|---|
| DE | 10004187 | C1 | 10/2001 |
| SU | 1291785 | A2 | 2/1987 |
| SU | 1749687 | A1 | 7/1992 |

* cited by examiner

METHOD FOR OPERATING A GAS AND STEAM TURBINE PLANT AND MONITORING A LIQUID LEVEL IN A PLURALITY OF DOWNPIPES

CROSS REFERENCE TO RELATED APPLICATIONS

This application is the U.S. National Stage of International Application No. PCT/EP2008/050954, filed Jan. 28, 2008 and claims the benefit thereof. The International Application claims the benefits of European Patent Office application No. 07002014.4 EP filed Jan. 30, 2007, both of the applications are incorporated by reference herein in their entirety.

FIELD OF INVENTION

The invention relates to a method for operating a gas and steam turbine plant in which flue gas exiting from a gas turbine is routed via a waste heat steam generator and in which a flow medium used for driving a steam turbine is conducted in a flow medium circuit comprising a number of pressure stages, with at least one of the pressure stages having an evaporator circuit with a steam collection drum with a number of downpipes connected to the steam collection drum and with a number of riser pipes downstream from the downpipes, likewise connected to the steam collection drum and heated by the flue gas in the waste heat steam generator. The invention further relates to a gas and steam turbine plant designed for such an operating method.

BACKGROUND OF INVENTION

In a combined gas and steam turbine plant the heat contained in the expanded operating medium or flue gas is used for evaporating a flow medium, usually water. The (water) steam thus produced is then used to drive a steam turbine. The heat is transferred in such cases in a waste heat steam collection drum or waste heat steam generator connected downstream on the flue gas side of the gas turbine, in which heating surfaces are arranged in the form of pipes or bundles of pipes in which the flow medium to be evaporated is conducted. These heating surfaces are usually a component of a flow medium circuit which also comprises the steam turbine and the condenser connected downstream from it, e.g. a water steam circuit, with the expanded flow medium exiting from the steam turbine being directed after its condensation in the condenser back again to the heating surfaces of the waste heat steam generator. As well as the evaporator heating surfaces, further heating surfaces can also be provided in the waste heat steam generator, especially for preheating the condensate or feed water or for superheating the generated steam. Furthermore a supplementary firing facility can also be integrated into the waste heat steam generator, for example an oil firing facility, in order to either raise the temperature of the flue gas above the level at its exit from the gas turbine, or with a decoupled or shut down gas turbine, to still be able to maintain the steam production in the waste heat boiler (so-called oil operation).

Usually the flow medium circuit comprises a number, for example three, pressure stages, each with its own evaporator section. A proven construction and design concept for such an evaporator section because its structure is kept comparatively simple and its relative ease of operation is based—at least in the area of less than critical steam pressures—on the natural circulation principle. In such cases a steam collection drum arranged above the flue gas flow channel of the waste heat steam generator, which is sometimes also referred to as the "top drum" serves as a reservoir for the preheated condensate or feed water arriving from the condensate or feed water pump, where necessary through a condensate pre-heater or an economizer. During operation a part of the stored water sinks downwards, driven by its own weight or by the hydrostatic pressure of the water column continuously through downpipes connected to the floor or sump of the steam collection drum. Via an intermediate distribution collector which is occasionally also referred to as the "bottom drum" the water which has dropped down is distributed to a number of riser pipes connected in parallel and bundled into heating surfaces heated by the heat contained in the flue gas and/or by the radiation heat generated by the additional burner of the waste heat boiler, in which the desired evaporation occurs. The heating surfaces formed from the riser pipes can in this case be part of the surrounding wall of the waste heat boiler or be arranged in the manner of bulkhead heating surfaces within the flue gas flow channel surrounded by the surrounding wall.

Because of its reduced density in relation to the liquid aggregate state, the water-steam mixture generated in the riser pipes by (part) evaporation of the water rises upwards and eventually arrives above the liquid level back in the steam collection drum, whereby the evaporator circuit is completed. The water-steam separation, also referred to as phase separation occurs in the steam collection drum; The water vapor present above the water level under saturated steam conditions is fed via a steam discharge pipe connected to the head of the steam collection drum and after superheating where necessary for its further use, e.g. for driving a steam turbine.

The evaporator stages based on the forced circulation principle are similarly constructed, but also feature a circulation pump connected into the evaporator loop which supports or forces the circulation of the water or of the water-steam mixture.

Because of the limited thermal load capability of the pipe wall materials usually used for the heating pipes or riser pipes in the prior art of science and technology it has been necessary to make absolutely sure that during operation of a gas and steam turbine plant the above-mentioned type of riser pipes of the respective evaporator stage are supplied in all operating states sufficiently with flow medium, as a rule water or water-steam mixture. The aim in such cases is to ensure a certain minimum cooling of the pipe walls as a result of the heat transfer from the internal pipe wall surface to the partly evaporating flow medium in this case and thus to avoid any damage to the evaporator circuit and any associated operating risks. In other words: A so-called dry operation of the evaporator or an operation with a reduced water level in which the column of liquid in the steam collection drum and in the downpipes connected to it sinks below a level of the connection of the downpipes or even the downpipes and the riser pipes connected downstream from them are operated completely "dry", so that practically no flow medium is flowing through them any more, is to be avoided under all circumstances.

These types of consideration are also the basis for the previously employed internationally valid regulations DIN EN 12592 which apply in accordance with part 1 to "water boilers with a volume of more than 2 liters for generating steam and/or hot water with a permitted pressure of more than 0.5 bar and a temperature of over 110° C. and which in accordance with part 7 defines the permitted lowest water level in the steam collection drum as "150 mm above the highest heated point of the drum and the highest connection of the downpipes (upper edge) to the boiler". The internationally valid successor standard DIN IEC 61508 and DIN IEC 61511 introduced into Germany in the year 2002 does not contain these types of detailed specifications explicitly any longer but the security requirements specified therein have not diminished in any way despite the more flexible framework specifications.

To enable adherence to the said minimum fill levels of liquid flow medium in the steam collection drum with rapid changes in load of the waste heat steam generator for example or with an unforeseen interruption or disconnection of the feed water supply as a result of faults and in order especially in the last mentioned case to be able to dissipate the residual heat present in the system in a safe and material-protective way, the volume of the steam collection drum and the quantity of flow medium retained in it in normal operation (feed water) is usually dimensioned comparatively large, taking into account a "safety margin". This is however associated with a correspondingly high manufacturing outlay and thereby also with high manufacturing costs.

In accordance with the particular relevance attributed to adhering to the minimum water level in the steam collection drum, in existing plants there is also a three-fold redundant measurement or monitoring of the current fill level related to the drum or to the upper edge of the downpipes, which requires a relatively expensive design of the associated safety facilities. As soon as a two-out-of-three selection from the three level measurements signals a fall in the water level to below a predefined limit value, e.g. 150 mm in accordance with DIN EN 12952, the safety system suppresses any further supply of the hot gas turbine exhaust gases into the waste heat steam generator, e.g. by rapid deactivation of the gas turbine or by operating a corresponding valve the waste gases are diverted into a bypass chimney, i.e. past the waste heat steam generator. In the interests of highest possible system availability such a fast deactivation is however definitely not desirable.

In addition the currently prescribed adherence to the water level of the medium-pressure drum (MD drum) and low-pressure drum ND drum) above the minimum level during oil operation demands a complex inlet temperature control for the economizer of the high-pressure and medium-pressure system and for the condensate pre-heater. Changes to stationary states through different operating conditions in oil operation result in internal heat displacements in the waste heat steam generator which influence the heat acceptance of the medium-pressure and low-pressure evaporator. These can for example cause fluctuations in the drum water levels of the MD and ND drums and an undesirably high increase in pressure in the ND drum. To keep these fluctuations within the required operating limits, the amounts of water via the HD and MD economizer bypass valves must be subject to the appropriate superimposed control which demands an increased control effort.

Finally the currently demanded adherence to the minimum water level in the ND steam collection drum leads in the fully explained run mode sleeping mode" of particular interest as regards its basic concept, in which for example, during a rapid deactivation of the steam turbine the HD steam generated in the HD line is diverted via a bypass line directly into the condenser (bypass operation), whereas through an explicit pressure relocation and a shift of the heat emission and reception in the waste heat steam generator the production of MD and ND steam is to be bought to a halt, to additional costs as a result of an ND steam collection drum having to be dimensioned comparatively large. The fall in the water level in the ND drum with a rapid deactivation of the steam turbine is namely especially drastic here by virtue of the explicit accompanying pressure increase in the ND system. By contrast with the original alignment of the concept, a low-pressure diversion station, which reduces the fall in the water level during a rapid deactivation of the steam turbine, cannot therefore be completely dispensed with.

SUMMARY OF INVENTION

The underlying object of the invention is thus to specify a method for operation of a gas and steam turbine plant of the type mentioned at the start but with high reliability and high operational safety that can be adapted especially flexibly to different types of operating states of the plant and that makes possible an especially low-cost design of the components of the respective evaporator circuit. In addition a gas and steam turbine plant suitable for executing the method is to be specified.

In relation to the method the object is achieved by the height of the liquid column formed by the flow medium in the downpipes connected to the steam collection drum being monitored.

The invention is based on the idea that, because of the progress achieved recently in materials technology and materials development for evaporator heating pipes compared to the versions previously occurring in the technical field. a design of a gas and steam turbine system is both concealable from a technical standpoint and is also competitive in practice under the given economic general conditions in which for at least part of the time during particular operating states part or also completely dry operation of a evaporator circuit, given a fall in the liquid level in the downpipes below the level of the steam collection drum, is tolerable.

In order to avoid permanent material damage and the associated operating dangers in such cases, on the one hand the riser pipes or the heating surfaces formed from them arranged in the flow channel of the waste heat steam generator should be designed in relation to their ability to withstand temperatures for the flue gas temperatures normally occurring during plant operation in the area of their mounting position, example 300° C. in an MD evaporator or 200° C. in an ND evaporator. The cooling which was previously always present from the flow medium normally conducted in the pipes should now no longer be calculated into the temperature design for a possible dry operation. Such requirements are easily fulfilled by a plurality of steels known to the person skilled in the art of which the temperature use limits are sometimes above 400° C. and the use of which can also be justified from the economic standpoint.

On the other hand the previously normal supervision and safety concept for such a gas and steam turbine system and especially for those evaporator circuits in which a temporary dry running is taken into consideration, should be explicitly adapted to the changed thermal loads and risks in relation to previous design principles for the structural integrity of the evaporator components. As a central input variable for the associated monitoring system and to decide about type and scope of any safety measures to be introduced, a measurement variable should in such cases be recorded which provides reliable information about impending dry operation as well as about its "extent".

For this reason, in accordance with the concept presented here beyond the previously usual level measurement in the steam collection drum, a measurement system detection of the fill level of the column of liquid formed by the liquid flow medium within the downpipes of the evaporator circuit is provided. In other words: The measurement facility does not just provide information about whether the liquid level is falling at all below a minimum level in the steam collection drum or below the level of the downpipe connections, but quantifies this state in greater detail by monitoring at least one further height level or a plurality of discrete height measurement points within the downpipe and resolves them for measurement. Naturally a continuous or semi-continuous measurement of the fill height in the downpipe can be provided expediently, with the distribution collector arranged at the lower end of the pipe as the reference point.

Provided a number of downpipes are connected to the steam collection drum and linked as a type of flow-side parallel circuit to a common distribution collector, the same fill level occurs in accordance with the principle of the communicating pipes in all downpipes, so that advantageously only the fill level in one of the pipes must be monitored.

In an advantageous embodiment the temperature of the flue gas in the area of the riser pipes is also monitored, with in one operating state a security measure being initiated with a liquid fill level below the connection to the steam collection drum in the downpipes as soon as the temperature of the flue gas exceeds a predetermined threshold value in the area of the riser pipes connected downstream from the downpipes.

In this way precisely in an operating state associated with an especially high risk with the possibility of the immediate onset of dry operation or with dry operation already having occurred with reduced flow medium throughput, the heating temperature acting from outside on the right pipes is monitored and if it falls below the value viewed as critical a safety reaction is initiated. In this case in particular a cascade of graduated limit values can be defined with, when a first limit value is exceeded, initially only a relatively "mild" countermeasure being initiated, for further temperature increases however more drastic countermeasures are increasingly initiated.

Advantageously the respective temperature limit value is predetermined in such cases as a function of a liquid fill level determined by measurement in the downpipes, so that the cooling influence of the remaining quantity of the flow medium passing through and thereby evaporating in the downstream riser pipes can be taken into account suitably in the decision about the type and time of initiation of safety measures.

A first, relatively mild safety measure preferably consists of opening a bypass line of a condenser preheater connected downstream on the flow medium side from the evaporator circuit or a feed water preheater arranged upstream on the flue gas side in order generally during different load change states, especially on startup and shutdown of the gas and steam turbine system, to prevent the permitted flue gas temperatures of the relevant evaporators being exceeded. If subsequently regular operation is to be started once more and steam is to be generated in the relevant evaporator stage, then the respective evaporator system is filled with hot water from the downstream economizer (for the MD evaporator) or from the condenser preheater (for the ND evaporator). By explicitly closing the cold condenser preheater bypass or the economizer bypass, the respective heating temperature is increased and steam production is initiated again.

Specifically with a three-pressure system with a condensate preheater, an MD economizer connected downstream from the condensate preheater for the feed water of the MD evaporator and an HD economizer connected downstream from the MD economizer for the feed water of the HD stage, the opening of the condensate preheater bypass line or the bypass line of the MD economizer leads in the standard case to, as described in DE 100 04 187 C1, the HD evaporator being arranged on the flue gas side before the MD evaporator and this in its turn before the ND evaporator, with the advantageous ancillary effect that now the evaporator circuit of the HD stage is supplied with comparatively cooler feed water, so that a comparatively large amount of heat is withdrawn from the flue gas of the gas turbine even in the entry area of the waste gas steam generator. The temperature stress—moderate in any event by comparison with the high-pressure stage—in the area of the MD and ND heating surfaces is reduced by this especially quickly and effectively if required. It is precisely with this type of effective demand-activatable safety measure that a temporary drying out of the MD and/or the ND evaporator circuit can thus be tolerated especially well.

Advantageously in this case the height of the column of liquid in the downpipes of the MD and/or of the ND evaporator and also the respective flue gas temperature are monitored, with a possible overload state of one of the two pressure stages being derived on the basis of the two parameters fill level and flue gas temperature assigned to them at the installation point of the heating surfaces. In the definition of temperature limit values for the initiation of safety measures expediently both the spatially-varying heating profile and also a possible different material choice and temperature arrangement for the various evaporator circuits is taken into consideration.

A further, more drastic safety measure can then consist of initiating a power reduction or a fast deactivation of the gas turbine, or for example, by actuating a bypass valve, diverting at least part of the flue gas coming out of the gas turbine past the waste heat steam generator.

In respect of the facility the object specified at the start is achieved by a gas and steam turbine plant, in which a level measurement facility to measure the height of the column of liquid formed by the flow medium in the downpipes connected to the steam collection drum is connected on the signal output side to a monitoring and control facility for the gas and steam turbine plant.

Advantageously the monitoring and control facility is further connected to a temperature measurement facility monitoring the temperature in the area of the riser pipes and is configured such that, in an operating state with liquid level lying below the connection to the steam collection drum in the downpipes, it initiates a safety measure as soon as the temperature measured by the temperature measurement device exceeds a predetermined limit value.

The benefits obtained with the invention consist especially of making it possible, by the explicit design of the plant architecture and the associated safety and monitoring systems, with a gas and steam turbine plant with a waste heat steam generator, for an evaporator system based on the natural circulation principle, especially the MD and/or the ND evaporator system, to be operated without danger at a water level far below the currently defined minimum water level or even to let the heating surfaces dry out without having to stop the operation of the waste heat steam generator or the gas turbine. In particular setting of flexible minimum water levels in the respective evaporator circuit as a function of a specific operating mode is possible without any safety implications.

It can be shown that such a concept also fulfils the safety standards defined by the new DIN IEC 61508 and DIN IEC 61511 norms and even exceeds them. The risk of rapid disconnection of the waste heat steam generator on rapid closing of the steam turbine control valves or with rapid changes in loads namely falls considerably if the water level in the evaporator circuit can fall below the drum level without danger. Thus the availability of the gas and steam turbine system is further increased, especially for rapid starts which are becoming increasingly important to compensate for short-term demand and supply variations in the power network. With gas and steam turbine plants in particular without a bypass chimney valve, a lower fast deactivation risk to the waste heat steam generator results in lower stresses and thus fewer equivalent operating hours for the gas turbine. In such cases, with the safety level remaining the same, the maintenance intervals on the gas turbine can be increased.

In addition the inventive concept makes possible a low-cost design and construction of components of the evaporator system which are usually very costly to manufacture, since in particular the MD and ND steam collection drums can be designed to be more compact than was previously necessary. This is of special relevance within the framework of the "sleeping mode" mode of operation described above, where the low-pressure bypass station for the ND evaporator is omitted, since the increase in drum size otherwise required to execute its operating mode can now be less or can even be dispensed with altogether. Finally the control outlay for adhering to condensate preheater and economizer inlet temperatures with oil operation is lower than before.

With corresponding modification and adaptation, the concept presented here can also be applied to gas and steam turbine plant with evaporator stages based on the forced circulation principle.

BRIEF DESCRIPTION OF THE DRAWINGS

An exemplary embodiment of the invention is explained in greater detail with reference to a drawing. The figures show in a schematic diagram in each case.

The same parts are provided with the same reference characters in the two figures.

DETAILED DESCRIPTION OF INVENTION

Figure 1:
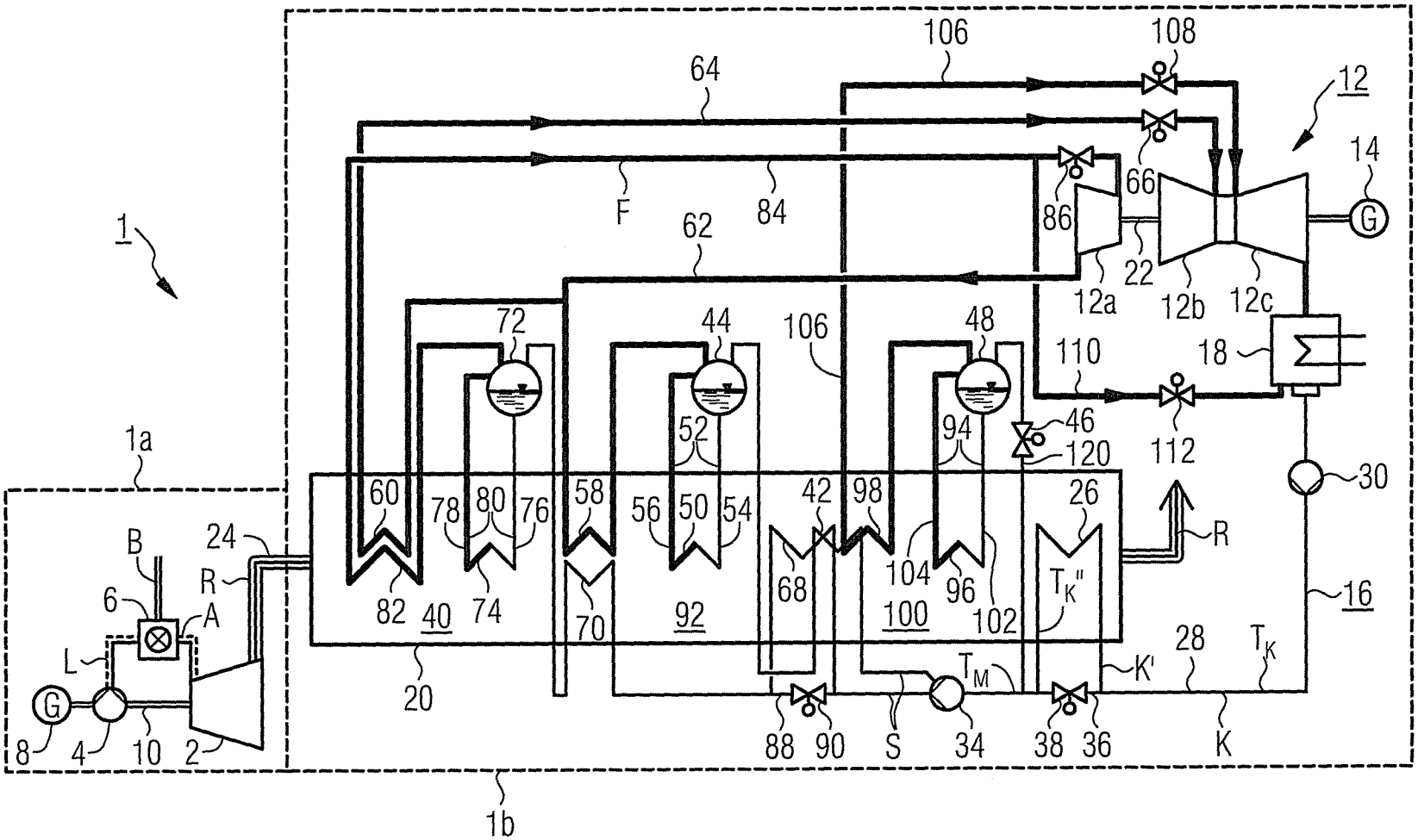
FIG. 1 a combined cycle gas and steam turbine plant.

The gas and steam turbine plant 1 in accordance with FIG. 1 comprises a gas turbine system 1*a* and a steam turbine system 1*b*.

The gas turbine system 1*a* comprises a gas turbine 2 with connected air compressor 4 and a combustion chamber connected upstream from the gas turbine 2, in which fuel B with the addition of compressed air from the air compressor 4 is burnt for the operating medium or combustion gas A for the gas turbine 2, The gas turbine 2 and the air compressor 4 as well as a generator 8 sit on a common turbine shaft 10.

The steam turbine system 1*b* comprises a steam turbine 12 with generator 14 coupled to it and in a flow medium circuit 16 embodied as a water-steam circuit, a condenser 18 connected downstream from the steam turbine 12 as well as a waste heat steam generator 20. The steam turbine 12 features a first pressure stage or a high-pressure part 12*a* and a second pressure stage or a medium-pressure part 12*b* as well as a third pressure stage or a low-pressure part 12*c*, which drive the generator 14 via a common turbine shaft 22.

To supply working medium or flue gas R expanded in the gas turbine 2 into the waste heat steam generator 20 a waste heat line 24 is connected on the input side to the waste heat steam generator 20. The expanded flue gas R from the gas turbine leaves the waste heat steam generator 20 on the output side in the direction of a chimney not shown in the figure.

The waste heat steam generator 20 comprises as its heating surface a condensate preheater 26 which is fed on its input side via a condensate line 28 into which a condensate pump is connected with condensate K from the condenser 18. The condensate preheater 26 is routed on its output side to the induction side of a feed water pump 34. To bypass the condensate preheater 26 if required, this is bridged by a bypass line 36 in which a motor-actuated valve 38 is located.

The feed water pump is embodied in the exemplary embodiment as a high-pressure feed pump with medium-pressure take-off. It brings the condensate K up to suitable pressure level for the high-pressure part 12*a* of the high-pressure stage 40 of the flow medium circuit 16 assigned to the steam turbine. The condensate K conducted via the feed pump which is referred to on the pressure side of the feed water pump 34 as feed water S, is fed under medium pressure to a feed water preheater 42. This is connected on the output side to a medium-pressure steam collection drum 44. In a similar way the condenser preheater 26 is connected on the output side via a motor-actuated valve 46 to a low-pressure steam collection drum 48.

The medium-pressure steam collection drum 44 is connected to a medium-pressure evaporator 50 arranged in the waste heat steam generator 20 for forming a medium-pressure evaporator circuit 52. The evaporator circuit 52 comprises a number of downpipes 54 only indicated schematically in FIG. 1 outside the flow channel of the waste heat steam generator heated up by flue gas R which are each connected at an upper end to the sump of the steam collection drum 44 and open out at their lower end into a distribution collector not shown here in any greater detail. Via the distribution collector a plurality of parallel-connected riser pipes 56 bundled into heating surfaces arranged in the waste heat steam generator 20 are fed with liquid flow medium, in this case water, from the steam collection drum 44 or from the downpipes 54 which, when it flows through the riser pipes, 56 is partly evaporated, rises upwards during the process and enters the steam collection drum 44 again as a water-steam mixture.

A medium-pressure superheater is connected on the steam side to the medium-pressure steam collection drum, which is connected on the output side to a waste steam line 62 connecting the high-pressure part 12*a* on the output side with an intermediate superheater 60. The intermediate superheater 60 in its turn is connected on its output side via a steam line 64, in which a motor-actuated valve 66 is connected, to the medium-pressure part 12*b* of the steam turbine 12.

On the high-pressure side the feed water pump 34 is conducted via a first high-pressure economizer 68 and a second high-pressure economizer 70 connected on the feed water side downstream from this and arranged within the waste heat steam generator 20 on the flue gas side, to a high-pressure steam collection drum 72. The high-pressure steam collection drum 72 is connected in its turn to a high-pressure evaporator 74 arranged in the waste heat steam generator 24 forming an evaporator circuit 18 comprising a number of downpipes 76 and riser pipes 78. To remove fresh steam F the high-pressure steam collection drum 72 is connected to a high-pressure superheater 82 arranged in the waste gas steam generator 20, which is connected on its output side to the high-pressure part 12*a* of the steam turbine 12 via a fresh steam line 84 to a motor-actuated valve 86. The first high-pressure economizer 68 is likewise bridged by a bypass line 88 in which once again a motor-actuated valve 90 is connected.

The feed water preheater 42 and the medium-pressure evaporator 50 as well as the medium-pressure superheater 58, fowl together with the intermediate superheater 60 and the medium-pressure part 12*b* of the steam turbine 12 the medium-pressure stage 92 of the flow medium circuit 16 embodied as a water steam circuit. Similarly a low-pressure evaporator 96 arranged in the waste heat steam generator 20 and connected for forming an evaporator circuit 94 to the low-pressure steam collection drum 48 together with a low-pressure superheater 98 connected on the steam side to the low-pressure steam collection drum 48 and the low-pressure part 12*c* of the steam turbine 12 form the low-pressure stage 100 of the flow medium circuit 16. In a similar way to the high-pressure evaporator circuit 80 and to the medium-pressure evaporator circuit 52, the low-pressure evaporator circuit 94 is composed of a number off downpipes 102 connected to the steam collection drum 48 and a number of riser pipes 104 connected downstream from these on the flow medium side. On the output side the low-pressure superheater 98 is linked via a steam line 106 in which a motor-actuated valve 108 is connected to the inlet of the low-pressure part 12*c* of the steam turbine 12.

To redirect or divert the high-pressure part 12*a* of the steam turbine 12 as required the fresh steam line 84 connecting the high-pressure superheater 82 with the high-pressure part 12*a* is linked via a steam line in which a motor-actuated valve 112 is connected directly to the condenser 18. In this case, the steam line 110 serving as the high-pressure diversion is connected in the direction of flow of the fresh steam F before the valve 86 to the fresh steam line 84.

In order with an especially low construction and manufacturing outlay to make possible a flexible adaptation of the mode of operation to different requirements, the gas and steam turbine plant 1 is designed so that the fill level of liquid flow medium in the downpipes 54, 102 of the medium-pressure evaporator circuit 52 and of the low-pressure evaporator circuit 94 can fall at least temporarily below the level of the connection to the respective steam collection drum 44, 48, if necessary right down to a completely dry operation of the evaporator circuit 52 or 94 respectively.

For this purpose the pipe wall material of the riser pipes 56, 104 connected downstream to the downpipes 54, 102 heated convectively by contact with the flue gas R, is selected in relation to its temperature resistance so that its temperature use limit lies above the temperature normally present or above the maximum temperature to be expected of the flue gas R in this area of the waste heat steam generator 20. For example the temperature of the flue gas R in the area of the medium-pressure evaporator 50 amounts under normal circumstances to around 300° C. and in the area of the low-pressure evaporator 96 to around 200° C. Provided for example the riser pipes 56 of the medium-pressure evaporator 50 are designed for a long-term temperature stability of around 400° C. and the riser pipes 104 of the low-pressure evaporator 96 for a long-term temperature stability of around 300° C., this means that as a rule sufficient safety reserves are available in order to tolerate a temporary dry running, e.g. on startup or shut down of the combined gas and steam turbine plant 1 or with rapid changes of load. This means that especially the medium-pressure steam collection drum 44 and the low-pressure steam collection drum 48 can be of an especially compact construction since the reserve volumes of liquid previously used respectively for compensating for different steam production rates and to guarantee a continuous feed of the riser pipes 56, 104 with flow medium can be comparatively small.

In order however above and beyond this, even in cases of unforeseen temperature peaks during an impending or already occurring dry operation of the medium-pressure evaporator circuit 52 and/or of the low-pressure evaporator circuit 94 to be able to react appropriately by initiation of safety measures, the combined gas and steam turbine plant 1 is equipped with a monitoring and/or control system for monitoring and control or regulation of these types of operating states. In particular the medium-pressure evaporator circuit 52 and the low-pressure evaporator circuit 94 will be monitored independently of each other in a way to be described below.

The monitoring of the low-pressure evaporator circuit 94 occurs as follows: As well as the previously usual monitoring of the water level in the low-pressure steam collection drum 48, indicated schematically in FIG. 2 by the double headed arrow 114, a fill level monitoring is now provided which also includes the downpipes 102 connected to the low-pressure steam collection drum 48, indicated schematically here by the double-headed arrow 116. A fill level measuring facility not shown in greater detail here thus measures the height of the column of water related to the lowest point of the downpipes 102 which extends during normal operation of the gas and steam turbine plant 1 right into the steam collection drum 48, but now during particular situations—as outlined above—can fall below the height level of the upper downpipe connections. There can also be provision for relating the fill level to the downpipe connections, meaning to the lowest point of the steam collection drum 48 and for example specifying a fill level lying above this with a positive leading sign and a fill level lying below this with a negative leading sign. Thus for example when the height of the downpipes 102 amounts to 2 meters, a fill level of "minus 1.9 m" would signal the possible immediate onset of completely dry operation.

Figure 2:
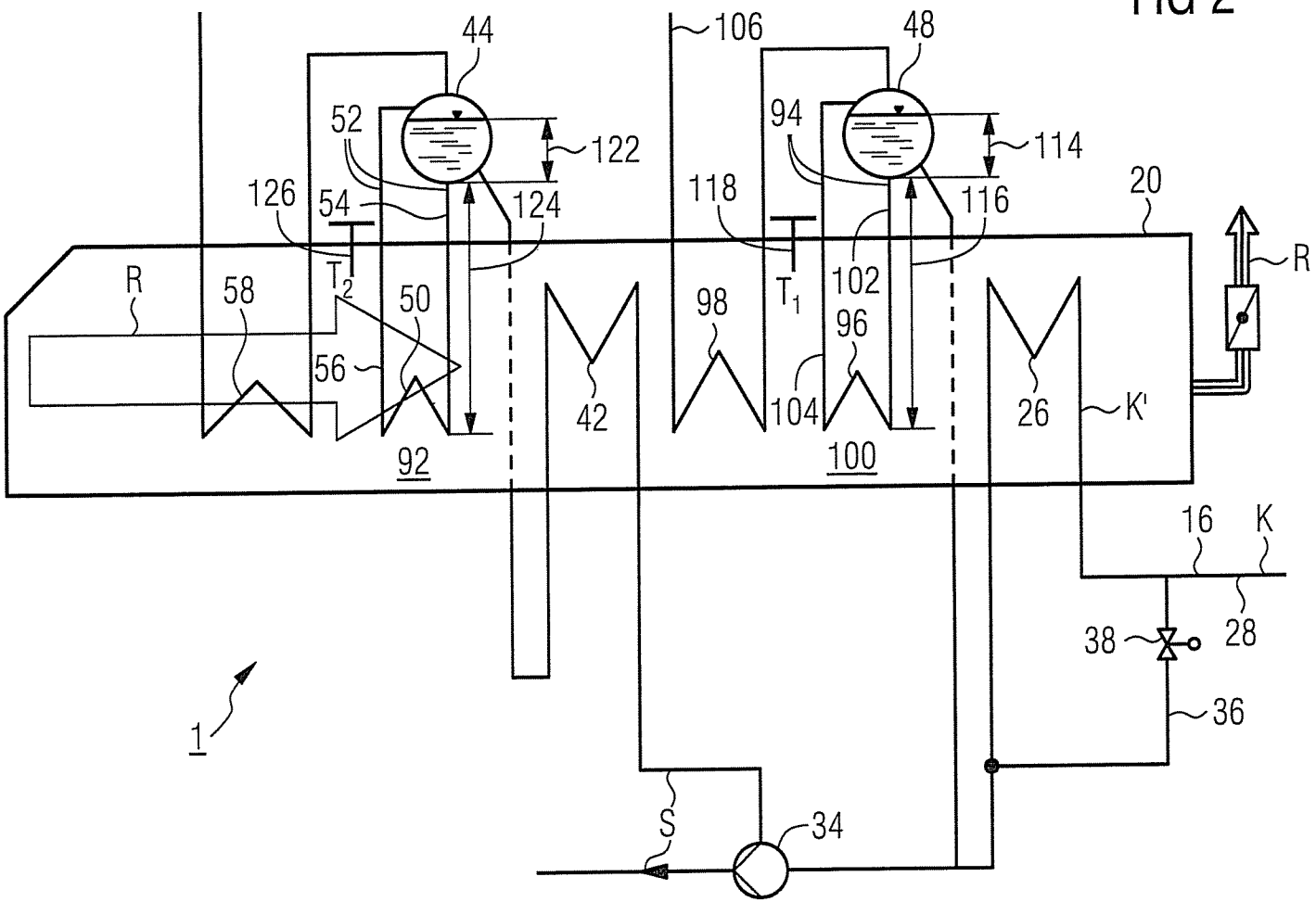
FIG. 2 a cross-section from FIG. 1, with in the interests of improved recognition of major components of the combined gas and steam turbine plant, a few details from FIG. 1 being omitted or being depicted in slightly modified form.

The fill level of the liquid flow medium measured in this way in the downpipes of the low-pressure evaporator circuit 94 is notified to a central evaluation and control unit for the gas and steam turbine plant 1 not shown in any greater detail here. A further input variable for monitoring is the temperature T1 of the flue gas R obtaining in the area of the riser pipes 104, which in the exemplary embodiment depicted in FIG. 2 is detected by a temperature measurement facility 118 or its temperature measurement sensor arranged, viewed in the direction of the flue gas R, shortly before the riser pipes 104 in the waste heat steam generator 20, shown only schematically in this diagram. The monitoring and control facility is configured or programmed such that in at least one operating state with a fluid fill level lying below the connection to the steam collection drum 48 in the downpipes 102, it initiates a safety measure as soon as the temperature T1 measured by the temperature measurement facility 118 exceeds a predetermined threshold value. This threshold value can in particular be predetermined depending on the liquid level in the downpipes 102.

If for example the temperature limits for the riser pipes 104 of the low-pressure evaporator circuit 94 is at 300° C., then for downpipes 102 filled up to half their height with water, a first limit value might be set at 290° C. at which initially the valve 38 lying in the bypass line 36 of the condensate pre-heater 26 is opened. In the case of completely dry operation this first limit value is expediently set correspondingly lower, e.g. at around 270° C.

The opening of the valve 38 leads to the condensate K on the induction side of the feed water pump 34 having a mixture temperature TM which is set as a result of the at least partial bypassing of the condensate preheater 26. The mixture temperature TM is lower than the condensate temperature TK when all the liquid is flowing through the condensate preheater 26, i.e. it is not being bypassed. Also for preheating a part flow K' in the condensate preheater 26 a mixture temperature TM is set which is lower than the temperature TK' of the condensate K leaving the condensate preheater 26 during operation of the steam turbine 12. In this way comparatively cold feed water S arrives both in the feed water preheater 42 and also in the first high-pressure economizer 68, with the result that the flue gas R is cooled off comparatively greatly in the direction of flow before the low-pressure stage 100. This means that the low-pressure stage 100, i.e. especially the low-pressure evaporator 96, receives comparatively little heat, while at the same time comparatively cool condensate K flows in through the condensate line 120 into the low-pressure steam collection drum 48. This means that depending on the position of the valve 38, the temperature load for the riser pipes 104 of the low-pressure stage 100 is greatly reduced and at the same time the water level in the low-pressure steam collection drum 48 or in the downpipes 102 connected to it is increased again so that potentially dangerous operating states resulting from the temporary dry operation of the low-pressure evaporator circuit 94 can be actively and explicitly counteracted if necessary.

Should, despite the measures described, the temperature T1 of the flue gas in the area of the low-pressure evaporator 96 increase again and exceed a second threshold value of for example 320° C. for downpipes 102 half filled with water or for example 300° C. for dry operation, the monitoring and control facility for the gas and steam turbine plant 1 initiates further safety measures, e.g. a rapid shutdown of the gas turbine system 1*a*.

The same applies to the monitoring of the medium-pressure evaporator circuit 52. This means that on the one hand a level measurement facility, indicated by the double headed arrow 124 for measuring the height of the column of liquid formed by the flow of medium in the downpipes 54 connected to the steam collection drum 44 and on the other hand a temperature measurement facility 126 arranged in the flue gas channel shortly before the riser pipes 56 for measuring the flue gas temperature T2 obtaining in the area of the riser pipes 56 are provided. Like the low-pressure evaporator circuits 94, a monitoring and control facility linked to the temperature and level measurement sensors is configured such that, in an operating state with a liquid level lying below the connection to the medium-pressure steam collection drum 44 in the downpipes 54, it initiates a safety measure as soon as the flue gas temperature 12 measured by the temperature measurement facility 126 exceeds a predetermined threshold value.

A first safety measure can for example in its turn consist of opening the valve 38 in the bypass line 36 for the condensate preheater 26. As an alternative or in addition the valve 90 in the bypass line 88 for the first high-pressure economizer 68 can be opened so that the second high-pressure economizer 70 is supplied with comparatively cooler feed water S. The second high-pressure economizer 70 thus removes from the flue gas R flowing in this area of the waste heat steam generator 20 additional heat compared to operation with closed bypass valves 38, 90, which is no longer available to the flue gas-side downstream medium-pressure heat surfaces or the riser pipes 56. This enables the temperature load for the riser pipes 56 to be reduced especially during dry operation. A second, more drastic safety measure can once again consist of a rapid shutdown of the gas turbine system 1*a*.

Especially advantageous is the opportunity of temporarily being able to run the medium-pressure evaporator circuit 52 or the low-pressure evaporator circuit 94 dry during the so-called bypass operation. Such bypass operation which is provided especially during startup or shutdown of the steam turbine 12 as well as for a rapid steam turbine shutdown leads to a redirection of the fresh steam F generated while bypassing the steam turbine 12 directly into the condenser 18. To this end the valve 86 is closed and the valve 112 opened. In parallel to this the condenser preheater 26 is at least partly bypassed by the valve 38 located in the bypass line 36 being opened. If necessary the valve 90 in the bypass line 88 is also opened so that as a result of the heat displacements described above in the waste heat and steam generator 20, the production of low-pressure steam and if necessary also of medium-pressure steam is restricted or even completely brought to a standstill. Thus merely high-pressure steam or fresh steam F is generated which however is introduced directly into the condenser 18 via the steam line 110 bypassing the steam turbine 12. The option of being able to run the medium-pressure evaporator circuit 52 and/or the low-pressure evaporator circuit 94 dry without danger means that the enlargement of the medium-pressure steam collection drum 44 or of the low-pressure steam collection drum 48 otherwise necessary for a gas and steam turbine plant without bypass stations is avoided compared to such plant in which bypass stations are present.

The invention claimed is:

1. A method for operating a gas and steam turbine plant, comprising:

routing a flue gas exiting a gas turbine through a waste heat steam generator;

conducting a flow medium used to drive a steam turbine in a flow medium circuit; and monitoring a height of a column of liquid formed by the flow medium in a plurality of downpipes connected to a steam collection drum, wherein the flow medium circuit comprises a plurality of pressure stages, wherein at least one of the pressure stages features an evaporator circuit including the steam collection drum with the plurality of downpipes connected to the steam collection drum and with a plurality of riser pipes connected downstream from the plurality of downpipes and connected to the steam collection drum, and wherein the plurality of riser pipes are heated by the flue gas in the waste heat steam generator.

2. The method as claimed in claim 1, further comprising monitoring a temperature of the flue gas in an area of the plurality of riser pipes, and wherein in an operating state when a liquid level is below a level of a connection to the steam collection drum in the plurality of downpipes, a safety measure is initiated when the temperature exceeds a predetermined threshold value.

3. The method as claimed in claim 2, wherein the threshold value is predetermined as a function of the liquid level in the plurality of downpipes.

4. The method as claimed in claim 2, wherein the safety measure includes opening a bypass line of a condensate preheater connected downstream from the evaporator circuit on a flow medium side or opening a feed water preheater arranged before the evaporator circuit on a flue gas side.

5. The method as claimed in claim 2, wherein the safety measure includes initiating a power reduction of the gas turbine plant or a rapid shutdown of the gas turbine plant and/or at least partially diverting the flue gas coming out of the gas turbine past the waste heat and steam generator.

6. The method as claimed in claim 1, further comprising monitoring the height of the column of liquid in the plurality of downpipes in a last evaporator circuit seen in the direction of flow of the flue gas, wherein the last evaporator circuit is embodied as a low-pressure circuit, and wherein the flow medium circuit comprises at least three pressure stages, each pressure stage including one evaporator circuit, with the plurality of riser pipes of the at least three evaporator circuits seen in the flow direction of the flue gas arranged behind one another in the waste heat steam generator.

7. The method as claimed in claim 6, further comprising monitoring the height of the column of liquid in the plurality of downpipes of a middle evaporator circuit seen in the direction of flow of the flue gas, and wherein the middle evaporator circuit is embodied as a medium-pressure evaporator circuit.

8. A gas and steam turbine plant, comprising:

a gas turbine;

a waste heat steam generator connected downstream from the gas turbine on an exhaust gas side; and a flow medium circuit comprising a plurality of pressure stages, wherein a flow medium used to drive a steam turbine is conducted in the flow medium circuit, wherein at least one of the pressure stages features an evaporator circuit including a steam collection drum with a plurality of downpipes connected to the steam collection drum and with a plurality of riser pipes connected downstream from the downpipes and connected to the steam collection drum, wherein the plurality of flue pipes is heated by the flue gas in the waste heat steam generator, wherein a level measurement facility measures the height of the column of liquid formed by the flow medium in the plurality of downpipes, and wherein the level measurement facility is connected on a signal side to a monitoring and control facility for the gas and steam turbine plant.

9. The gas and steam turbine plant as claimed in claim 8, wherein the monitoring and control facility is linked on the signal side to a temperature measurement facility monitoring the temperature of the flue gas in the area of the plurality of riser pipes, and wherein the monitoring and control facility is configured such that, in an operating state when a liquid level is below a level of a connection to the steam collection drum in the plurality of downpipes, a safety measure is initiated as soon as the temperature measured by the temperature measurement facility exceeds a predetermined threshold value.

10. The gas and steam turbine plant as claimed in claim 9, wherein the threshold value is predetermined as a function of the liquid level in the plurality of downpipes.

11. The gas and steam turbine plant as claimed in claim 9, wherein the safety measure includes opening a bypass line of a condensate preheater connected downstream from the evaporator circuit on a flow medium side or opening a feed water preheater arranged before the evaporator circuit on a flue gas side.

12. The gas and steam turbine plant as claimed in claim 9, wherein the safety measure includes initiating a power reduction of the gas turbine plant or a rapid shutdown of the gas turbine plant and/or at least partially diverting the flue gas coming out of the gas turbine past the waste heat and steam generator.

13. The gas and steam turbine plant as claimed in claim 8, further comprising monitoring the height of the column of liquid in the plurality of downpipes in a last evaporator circuit seen in the direction of flow of the flue gas, wherein the last evaporator circuit is embodied as a low-pressure circuit, and wherein the flow medium circuit comprises at least three pressure stages, each pressure stage including one evaporator circuit, with the plurality of riser pipes of the at least three evaporator circuits seen in the flow direction of the flue gas arranged behind one another in the waste heat steam generator.

14. The gas and steam turbine plant as claimed in claim 13, further comprising monitoring the height of the column of liquid in the plurality of downpipes of a middle evaporator circuit seen in the direction of flow of the flue gas, and wherein the middle evaporator circuit is embodied as a medium-pressure evaporator circuit.

* * * * *